United States Patent [19]

Ichiyama et al.

[11] 4,363,677

[45] Dec. 14, 1982

[54] METHOD FOR TREATING AN ELECTROMAGNETIC STEEL SHEET AND AN ELECTROMAGNETIC STEEL SHEET HAVING MARKS OF LASER-BEAM IRRADIATION ON ITS SURFACE

[75] Inventors: Tadashi Ichiyama, Sagamihara; Shigehiro Yamaguchi, Fujisawa; Tohru Iuchi, Kawasaki; Motoharu Nakamura, Himeji; Yozo Suga, Kitakyushu, all of Japan

[73] Assignee: Nippon Steel Corporation, Tokyo, Japan

[21] Appl. No.: 227,379

[22] Filed: Jan. 22, 1981

[30] Foreign Application Priority Data

Jan. 25, 1980 [JP] Japan ..... 55-6998
Jan. 25, 1980 [JP] Japan ..... 55-7000
Jan. 25, 1980 [JP] Japan ..... 55-7475

[51] Int. Cl.[3] ..... H01F 1/04

[52] U.S. Cl. ..... 148/111; 148/112; 148/31.5

[58] Field of Search ..... 148/110, 9.5, 111, 112, 148/113, 31.55, 31.5

[56] References Cited

U.S. PATENT DOCUMENTS

| | | | |
|---|---|---|---|
| 3,192,078 | 6/1965 | Gordon et al. | 148/100 |
| 3,647,575 | 3/1972 | Fiedler et al. | 148/111 |
| 3,856,568 | 12/1974 | Tanaka et al. | 148/12 A |
| 3,932,236 | 1/1976 | Wada et al. | 148/31.55 |
| 3,947,296 | 3/1976 | Kumazawa | 148/31.55 |
| 3,990,923 | 11/1976 | Takashina et al. | 148/111 |
| 4,063,063 | 12/1977 | Funck et al. | 148/9.5 |
| 4,130,447 | 12/1978 | Marianeschi et al. | 148/31.55 |
| 4,242,155 | 12/1980 | Morito et al. | 148/113 |

*Primary Examiner*—John P. Sheehan
*Attorney, Agent, or Firm*—Kenyon & Kenyon

[57] ABSTRACT

A process of providing electromagnetic steel strips or sheet with excellent magnetic properties. The process comprises the steps of:

irradiating with a laser-beam the surface of an electromagnetic steel sheet which has been finally annealed, thereby locally forming marks of the laser-beam irradiation on the surface of the steel, and;

subsequently, subjecting the steel sheet to the formation of an insulating film on the sheet surface at a temperature of the sheet not exceeding 600° C.

8 Claims, 11 Drawing Figures

METHOD FOR TREATING AN ELECTROMAGNETIC STEEL SHEET AND AN ELECTROMAGNETIC STEEL SHEET HAVING MARKS OF LASER-BEAM IRRADIATION ON ITS SURFACE

The present invention relates to a method for treating electromagnetic steel strips or sheets as well as electromagnetic steel strips or sheets treated by laser-beam irradiation.

Electromagnetic steel sheets include non-oriented electromagnetic steel sheets used for rotary machines, such as motors, and grain-oriented electromagnetic steel sheets used for transformers and the like. Non-oriented electromagnetic steel sheets are produced by preparing hot-rolled coils of pure iron or steel containing up to 3.5% of silicon, by pickling and by repeating cold rolling and annealing once or twice, thereby orienting the directions of easy magnetization at random with regard to the rolling direction. Finally, an insulating film is applied on the sheet surface of the non-oriented electromagnetic steel sheets. The grain-oriented electromagnetic steel sheets are comprised of crystal grains which have a so called Goss texture and which have an (110)[001] orientation expressed on the Miller index. This designation indicates that the (110) plane of the crystal grains are parallel to the sheet surface, while the [001] axis of the crystal grains, i.e. the direction of easy magnetization, is parallel to the rolling direction. In the production of the grain-oriented electromagnetic steel sheets, the components of steel are adjusted so that the silicon content is in the range of from 2.5 to 3.5% and further elements functioning as inhibitors, e.g. AlN, MnS, BN, Se, CuS, Sb, are contained in a predetermined amount. Hot rolled coils of the steel having the above mentioned composition are pickled and cold reduced by repeating cold rolling followed by annealing once or twice. Subsequently, the final annealing is carried out at a temperature of from 1000° to 1200° C., so as to preferentially grow the (110)[001] grains due to a secondary recrystallization. When the final annealing is batchwise and hence the steel is annealed in the form of a coil, such refractory oxides as magnesia, silica, alumina and titanium oxide are used as an annealing separator for preventing sticking between sheet surfaces. When the annealing separator is mainly composed of magnesia, not only the sticking is prevented, but also a glass film mainly composed of forsterite ($2MgO.SiO_2$) is formed during the annealing due to a reaction between the magnesia (MgO) and silica ($SiO_2$) present on the sheet surface. This glass film is not only useful for the undercoat of an insulating film but is also effective for decreasing the watt loss and the magnetostriction because the glass film exerts a tension on the steel strips.

The grain-oriented electromagnetic steel strips having the secondarily recrystallized structure as a result of the final annealing and the glass film applied thereon are subjected to the removal of excess magnesia and then coated with liquid agents for forming insulating film, based on for example magnesium phosphate as disclosed in Japanese Published Patent Application No. 1268/1952, and colloidal silica, aluminum phosphate and chromic acid as disclosed in Japanese Published Patent Application No. 28375/1978. The thus coated steel strips are heated to a temperature of from 700° to 900° C. so as to bake the liquid agents mentioned above and simultaneously to remove the coiling inclination of the steel strips and thus to flatten the steel strips. When the liquid agent containing colloidal silica, such as the liquid agent disclosed in Japanese Published Patent Application No. 283751/1978, is baked, the film is rendered glassy and exerts tension on the steel strips during cooling from the baking temperature. The improving effects of watt loss and magnetostriction due to the tension are advantageously high when the coating amount of the colloidal silica-containing agent is high, i.e. from 4 to 7 g/cm$^2$. Such a high coating amount leads to good insulating property but a low space factor when forming an iron core, and also there arise problems in the working of the electromagnetic steel strips or sheets by slitting and shearing, that is, the insulating film is peeled at the edges of the electromagnetic steel sheets during the working.

Takashi Ichiyama, Shigehiro Yamaguchi, Tohru Iuchi and Katsuro Kuroki proposed, in U.S. patent application Ser. No. 58,757 on which U.S. Pat. No. 4,293,350 issued Oct. 6, 1981, a method of irradiating the finally annealed steel strip or sheet by a pulse laser beam, thereby considerably reducing the watt loss. They disclosed that their method could be used after the strip or sheet was coated with an insulating film. The present inventors further investigated the laser beam irradiation method as to how the insulating property of the film and therefore the ability to withstand high voltage, and the space factor of the electromagnetic steel sheets can be further improved by the laser-beam irradiation as compared with the Ichiyama et al U.S. Pat. No. 4,293,350, and how to not deteriorate, in the baking process of the liquid agent for forming an insulating film, the excelent watt loss and magnetostriction achieved by the laser-beam irradiation.

It is an object of the present invention to provide a method for treating electromagnetic steel strips or sheets, capable of providing such steel or sheet with excellent magnetic properties, i.e. low watt loss and low magnetostriction, and an improved insulating property, space factor, and workability.

It is another object of the present invention to provide electromagnetic steel strips or sheets with an insulating film, having excellent magnetic properties, insulating property, space factor, ability to withstand high voltage and workability.

In accordance with the objects of the present invention, there is provided a method for treating an electromagnetic steel sheet comprising the steps of:

irradiating by using a laser-beam the surface of an electromagnetic steel sheet which has been finally annealed, thereby locally forming marks of the laser-beam irradiation on the surface of the steel sheet, and;

subsequently, subjecting the steel sheet to the formation of an insulating film on the sheet surface at a temperature of the sheet not exceeding 600° C.

According to the research of the present inventors, the optimum result of watt loss reduction is obtained when the laser-beam irradiation is conducted to such an extent that laser marks are formed on the sheet surface. Desirably according to the U.S. Pat. No. 4,293,350, no laser marks should be formed in the light of the insulating property and ability to withstand high voltage. However, the improvement in the watt loss due to laser-beam irradiation can be realized without causing deterioration in the insulating property and ability to withstand high voltage, when an insulating film having a predetermined thickness is formed on the sheet surface after the laser-beam irradiation in accordance with the method to be explained hereinafter.

Conventionally, the baking or conversion of a liquid agent to the insulating film is conducted simultaneously with the flattening of the steel strip at the sheet temperature of from 700° to 900° C. It was proven by the present inventors that, when the sheet temperature exceeds 600° C. after the laser-beam irradiation, the effects of the laser-beam irradiation disappear. The baking temperature should therefore not exceed 600° C. Although the laser-beam irradiation causing marking of the sheet surface might be conducted after the formation of the insulating film, the insulating film is likely to vaporize due to the laser-beam irradiation, and if so the underlying steel surface is exposed, with the result that the insulating property and ability to withstand high voltage are drastically deteriorated. Therefore, the laser-beam irradiation is carried out in the present invention prior to the formation of the insulating film.

The electromagnetic steel sheet according to the present invention, has marks of a laser-beam irradiation in the form of a row on the sheet surface and an insulating film on the uppermost surface thereof.

The present invention is explained in detail with reference to the drawings, wherein.

Figure 1A:
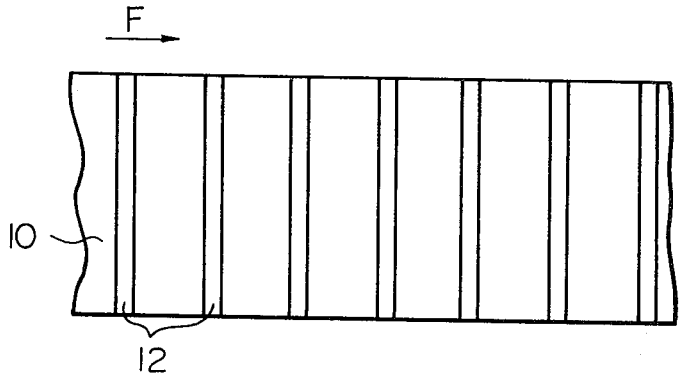
FIGS. 1A and 1B illustrate an outline of the laser-beam irradiation.

As described hereinabove, the grain-oriented electromagnetic steel sheet has a (110)[001] texture and is easily magnetized in the rolling direction. Referring to FIG. 1A, the grain-oriented electromagnetic steel sheet 10 is irradiated with a laser beam scanned substantially perpendicular to the rolling direction F. The reference number 12 indicates the laser-irradiation regions of the steel sheet in the form of rows. The fact that the watt loss is reduced by the laser-beam irradiation can be explained as follows.

Figure 2A:
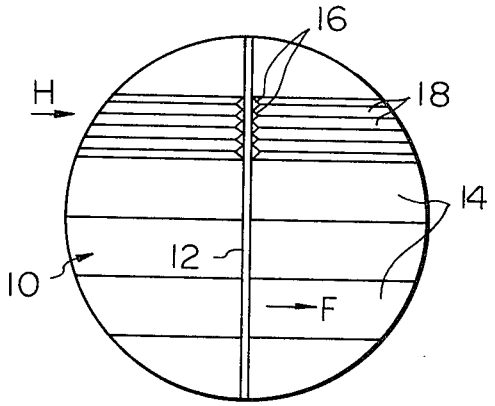
FIGS. 2A and 2B illustrate a reason for the watt loss reduction.

The grain-oriented electromagnetic steel sheet 10 possesses relatively large magnetic domains 14 which are elongated in the rolling direction as illustrated in FIG. 2A. With a higher degree of (110)[001] texture the crystal grains, through which the domain walls extend, and thus the magnetic domains bounded by the domain walls, are caused to be larger in the grain-oriented electromagnetic steel. Since the watt loss is proportional to the size of the magnetic domains, a problem of inconsistency resides in the fact that the material, which has a higher degree of texture and thus larger grains, does not display the watt loss which is reduced proportionally to the higher degree of crystal texture.

When the grain-oriented electromagnetic steel sheet is irradiated with a laser beam scanned substantially in the cross rolling direction, so as to extend the laser-irradiation regions 12 substantially in the cross rolling direction, a group of small projections 16 are generated along both sides of the laser-irradiation regions 12. A scanning type electron microscope can detect the small projections, which extend along both sides of the laser-irradiation regions 12, but which are only partly shown in FIGS. 2A and 2B. The small projections would be nuclei of magnetic domains, having 180° domain walls causing the magnetic domains 14 of the grain-oriented electromagnetic steel sheet 10 to be subdivided when the grain-oriented electromagnetic steel sheet 10 is magnetized. As a result of the subdivision of the magnetic domains the watt loss is reduced. It is believed that, when the steel sheet is irradiated by a high power laser, strong elastic and plastic waves are generated in the steel sheet. Probability of generation of the nuclei is believed to be proportional to a density of dislocations which are generated by the plastic waves.

Figure 1B:
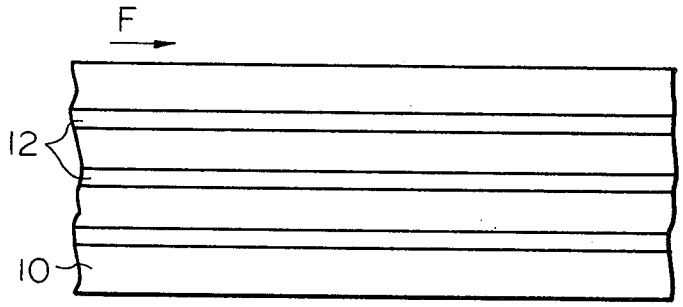
Figure 2B:
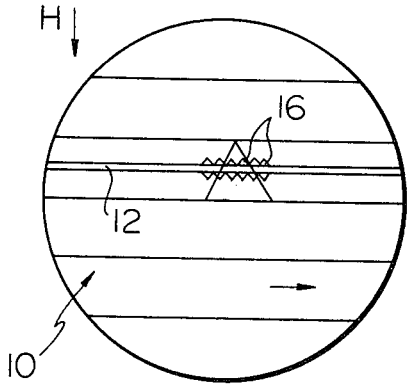

Referring to FIG. 1B, the grain-oriented electromagnetic steel sheet 10 is irradiated with a laser beam scanned in the rolling direction F. As a result of the irradiation, the laser-beam irradiation marks are arranged in the rolling direction. Referring to FIG. 2B, a group of small projections 16 generated by the laser-beam irradiation are illustrated. The small projections 16 seem to function as nuclei of magnetic domains (not shown) having 90° domain walls. Namely when the external magnetic field H is applied to the steel sheet 10, the 90° domain walls seem to develop from the small projections 16 which cause the formation of minute magnetic domains (not shown) aligned parallel in the direction of the external magnetic field, and which thus lead to the reduction of the watt loss.

Figure 3A:
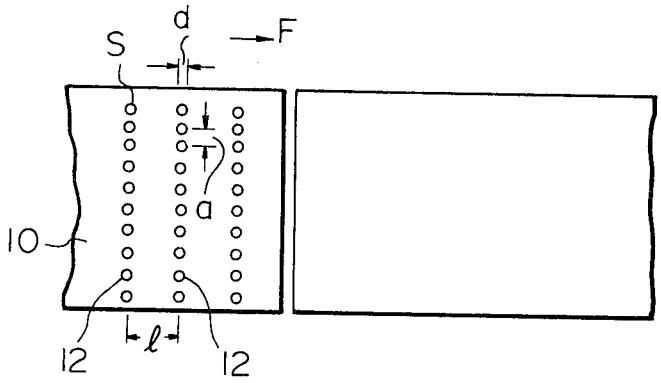
FIGS. 3A and 3B are views similar to FIGS. 1A, 1B and FIGS. 2A, 2B, respectively.
Figure 3B:
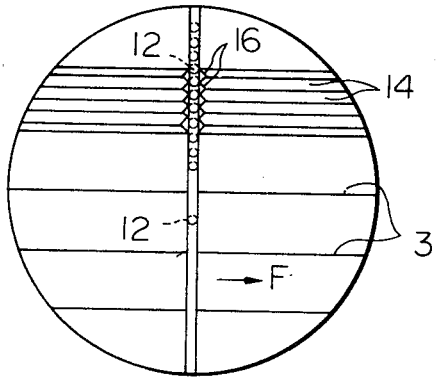

FIGS. 3A and 3B are drawings similar to FIGS. 1A and 1B, respectively, however in FIGS. 3A and 3B the laser-irradiation regions 12 are formed by the laser marks in the form of spots arranged in rows. Small projections 16 formed as a result of irradiation by a high power pulse laser subdivide the magnetic domains 14 and reduce the watt loss.

The methods and conditions of the laser-beam irradiation are hereinafter explained.

The laser beam is applied on either one or both surfaces of the electromagnetic steel strips or sheets. The shape of steels to be treated by laser-beam irradiation may be either strip or sheets cut or slit to a predetermined dimension. The laser-irradiation regions 12 may be linear or in the form of spots and/or broken lines. The energy density (P) of the laser is appropriately from 0.01 to 1000 J/cm$^2$. When the energy density (P) is less than 0.01 J/cm$^2$, a watt loss reduction cannot be realized, while the laser beam having an energy density (P) of more than 1000 J/cm$^2$ extremely damages the sheet surface so that the laser-beam irradiation cannot be applied practically.

When the laser-beam irradiation regions are in the form of spots as shown in FIG. 3A, preferable laser-beam irradiation conditions are as follows.

Figure 4:
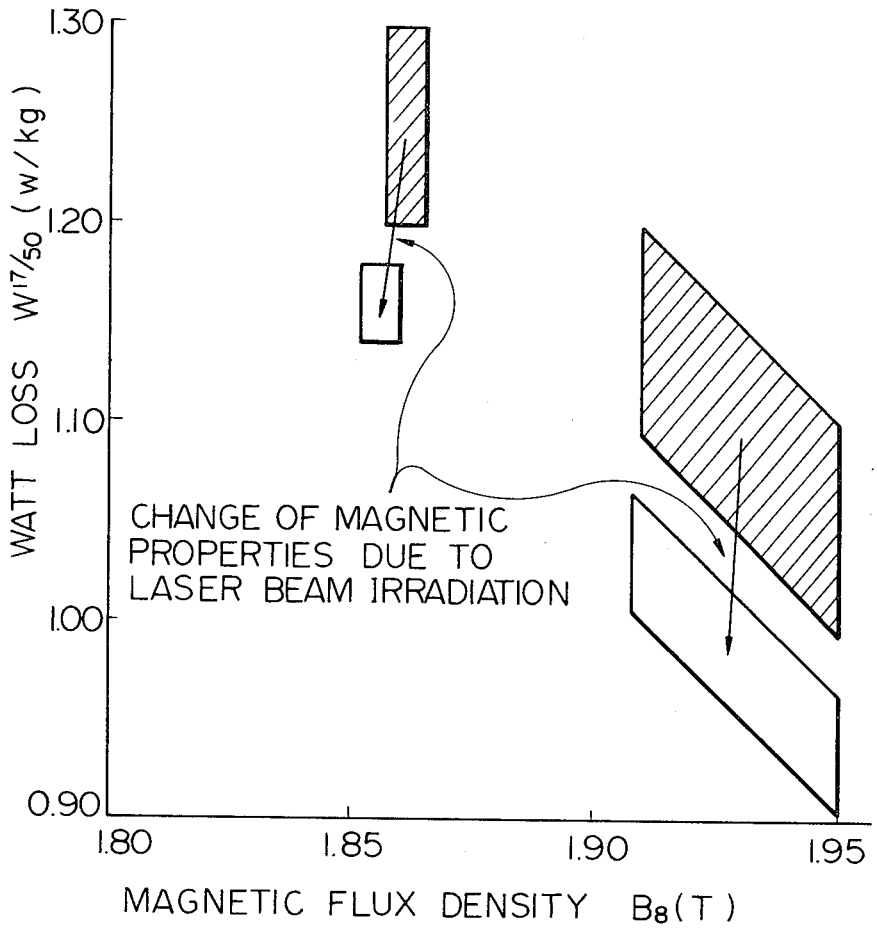
FIG. 4 is a graph illustrating a watt loss reduction according to the present invention.

Area of each mark (s): not less than $10^{-5}$ mm$^2$ Mark diameter (d): 0.004~1 mm, preferably 0.001~1 mm Distance (a) of marks from each other in the cross rolling direction: 0.004~2 mm, preferably 0.01~2 mm Distance (l) of marks from each other in the rolling direction: 1~30 mm Pulse width: 1 nS~100 ms Referring to FIG. 4, the watt loss reduction of electromagnetic steel sheets treated under the following conditions is illustrated.

Area of each mark (s): $10^{-5}$~$10^{-1}$ mm$^2$.

Distance (a) of marks from each other in the cross rolling direction: 0.1~0.5 mm Distance (l) of marks from each other in the rolling direction: 1~10 mm.

P (Energy density): 0.01~1000 J/cm$^2$.

As is apparent from FIG. 4 the watt loss reduction ($\Delta w$) of at least 0.03 Watt/kg is achieved by laser-beam irradiation under the above conditions.

When the laser-beam irradiation regions are in the form of broken lines, preferably laser-beam irradiation conditions are as follows.

Mark width: 0.003 to 1 mm

Mark length: not less than 0.01 mm

Distance of marks from each other in the cross rolling direction: 0.01~2.0 mm

Distance of marks from each other in the rolling direction: 1~30 mm

Pulse width: 1 ns~100 ms.

Figure 5:
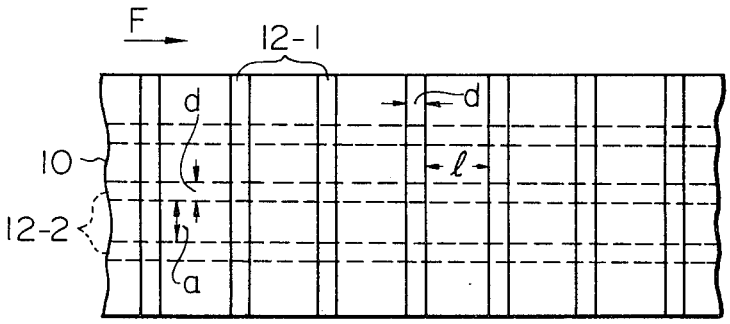
FIGS. 5 through 7 illustrate several shapes of laser marks according to the present invention.
Figure 6:
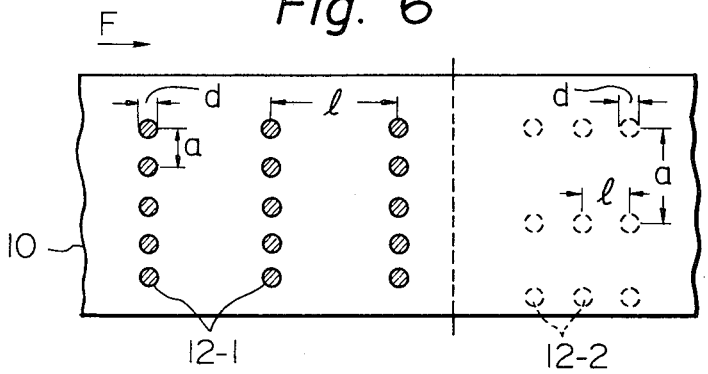
Figure 7:
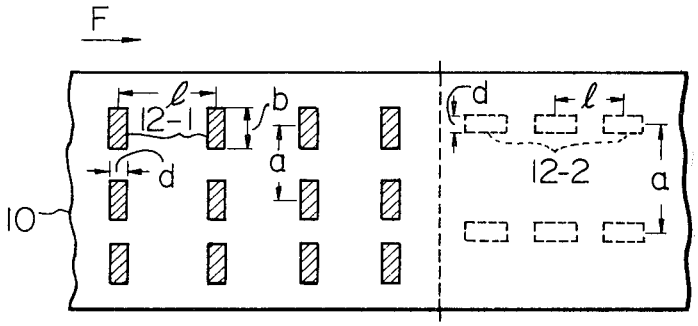

Referring to FIGS. 5 through 7, the marks of the laser-beam irradiation are schematically illustrated. In FIG. 5, the laser-irradiation regions 12-1 and 12-2 are linearly extended in the cross rolling direction and rolling direction (F), respectively. The surface, on which the laser-irradiation regions 12-2 are formed, may be the same as or opposite to the surface, on which the laser-irradiation regions 12-1 are formed. The width (d) of the laser-irradiation regions 12-1 and 12-2 may be in the range from 0.003 to 1 mm and the distances (l, a) may be in the range of from 1 to 30 mm. FIG. 6 is the same drawing as FIG. 3A except that the laser-irradiation regions 12-2 are formed on the opposite surface to that where the laser-irradiation regions 12-1 are formed. In FIG. 7, the laser-irradiation regions 12-1 and 12-2 are in the form of broken lines which extend in the cross rolling direction (12-1) and the rolling direction F (12-2), respectively. These regions may have a width (d) in the range of from 0.003 to 1 mm, length (b) in the range of not less than 0.01 mm, the distance from each other (l) in the rolling direction ranging from 1 to 30 mm and the distance (a) in the cross rolling direction ranging from 0.01 to 2 mm.

Although the rows of the laser-irradiation regions shown in FIGS. 5 through 7 are parallel to either the rolling direction or cross rolling direction, the direction of the laser-irradiation regions 12-1 may be slanted to the cross rolling direction and the direction of the laser-irradiation regions 12-2 may be slanted to the rolling direction (F). The deviation angle of the laser-irradiation regions 12-1 and 12-2 from either the rolling or cross rolling direction may be less than 45°.

The laser to be used is preferably a pulse laser, since the object of the laser beam irradiation is to subdivide the magnetic domain as a result of impact exerted on the sheet surface. A continuous output laser available in the laser market may be used but is not so effective as the pulse laser. The spot marks formed by the pulse laser irradiation may be continuous to one another or partially overlap with one another. The marks in the form of thin lines can be formed by using an optical system, such as a cyclindrical lens. The marks in the form of strips or chain lines can be formed by using an appropriate optical system and a slit.

The surface of the steel strips or sheets, on which the laser beam is applied, may be under any condition or state, such as mirror finish, coated by an oxide film or black film for enhancing the penetration characteristic of the laser, or coated by a glass film. In addition, the electromagnetic steel strips or sheets, which are finally annealed, may be directly subjected to the laser beam irradiation without undergoing any surface treatment.

Figure 8:
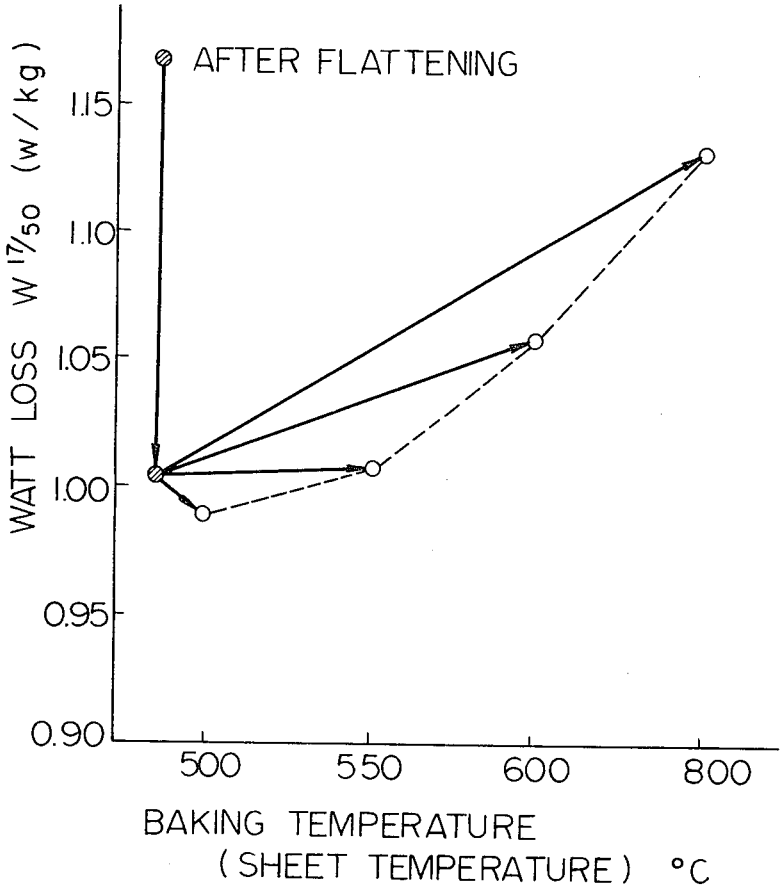
FIG. 8 is a graph illustrating a relationship between the watt loss and the insulating film baking temperature (sheet temperature).

The method for forming the insulating film on the surface of the electromagnetic steel sheet with or without the oxide film, black film, glass film and the like is hereinafter explained. Referring to FIG. 8, the relationship between the baking temperature for forming an insulating film and the watt loss of grain-oriented electromagnetic steel sheets having a high magnetic flux density is illustrated. The electromagnetic steel strips were irradiated by a laser beam and then subjected to the formation of an insulating film. The grain-oriented electromagnetic steel strips had a glass film on the surface thereof and were subjected to: (1) flattening at 700° C. over a period of 70 seconds in an $N_2$ atmosphere; (2) then, the laser-beam irradiation by pulse laser under the condition of energy density (P)=15 J/cm$^2$, irradiation pattern in the form of spots arranged in the cross rolling direction and on one sheet surface (FIG. 3A), the diameter (d) of each spot=0.1 mm, the distance (a) of spots from each other in the cross rolling direction=0.5 mm and the distance (l) of spots in the rolling direction (F)=10 mm; and (3) finally, the coating of a liquid agent composed of $Al(H_2PO_4)_3$-$CrO_3$-colloidal silica at an amount of 3 g/m$^2$.

As is apparent from FIG. 8, the watt loss ($W_{17/50}$) of 1.18 W/kg after the flattening is drastically reduced by the laser-beam irradiation to 1.00 W/kg. The watt loss values after the laser-beam irradiation is, however, greatly varied depending upon the temperature (sheet temperature) of the process for forming the insulating film. When the sheet temperature exceeds 600° C., the effects of the laser-beam irradiation are extremely impaired. The watt loss values after the formation of the insulating film can be equivalent to or lower than those obtained by the laser-beam irradiation, when the baking temperature is not more than 550° C. It is to be specifically noted that, by the formation of insulating film at a temperature of 500° C. or lower, the watt loss after the formation of insulating film can be lower than that obtained by the laser-beam irradiation. This is very unexpected and the reason why the watt loss decreases by baking at a temperature of not more than 500° C. is not yet clear to the present inventors.

In an embodiment of the present invention, the treating method comprises the steps of: subsequent to the final annealing, removing an excess of an annealing separator which is applied on to an electromagnetic steel strip coil; then, conducting the flattening of the electromagnetic steel coil, preferably, at a temperature in the range of from 700° to 900° C. then; irradiating the steel sheet surface by a laser beam, and; finally, forming an insulating film on the sheet surface at a temperature of not more than 600° C., preferably not more than 550° C., and more preferably not more than 500° C.

In the present invention, an agent free from colloidal silica can be applied on the sheet surface, which has been irradiated by the laser beam, and then baked to form the insulating film. Since the improvement in the watt loss reduction as a result of the laser-beam irradiation is conspicuous, the conventional tension effect by an insulating film can be mitigated or compensated for by the effect of the laser-beam irradiation. Therefore, instead of an expensive agent with colloidal silica, an agent free from the colloidal silica can be used for forming the insulating film. In addition, it is not necessary to thickly apply the agent for forming the insulating film except in a case where a specifically high resistance of electromagnetic steel sheets is required. The application amount of such agent may be from 2 to 3 g/m$^2$. As a result of the thin application of the agent for forming the insulating film, the space factor of laminated electromagnetic steel sheets is not substantially increased. In addition, workability of these sheets can be enhanced, and the insulating film does not peel at slitting or cutting.

In the present invention, an annealing separator may be free from magnesium oxide (MgO) or may contain magnesium oxide in a small amount. The annealing separator used in the present invention may be mainly composed of aluminum oxide ($Al_2O_3$). The tension effect on the glass film (forsterite) formed during the final annealing can be eliminated or compensated for by the effect of the laser-beam irradiation. The annealing separator applied on the sheet surface is not limited to that mainly composed of magnesium oxide, with the consequence that, because of no presence of glass film, the space factor and workability are further enhanced.

Conventionally, in the batchwise final annealing, a long time for annealing after the completion of satisfactory secondary-recrystallization has been necessary for purification and thus the enhancement of the watt loss property. However, in the present invention, excellent magnetic flux density is obtained as a result of the secondary recrystallization only, because the watt loss property can be enhanced by the laser-beam irradiation of the finally annealed electromagnetic steel strips or sheets. Thus, the final annealing time can be shortened as compared with the conventional annealing, with the result that fuel and energy can be greatly saved and thus production cost is reduced in the method of the present invention.

The electromagnetic steel strips or sheets without a glass film can be produced by using an annealing separator mainly composed of $Al_2O_3$, as explained hereinabove. In addition, the electromagnetic steel strips or sheets without glass film can be produced by removing the glass film by pickling and then irradiating the steel strips or sheets by laser beam. By the pickling, not only glass film but also any oxide film can be removed from the sheet surface, and, therefore, laser-beam irradiation is more effective for the enhancement of the watt loss property than the irradiation on the sheet surface having an oxide or glass film.

Although the type of final annealing explained hereinabove is batchwise annealing of coils, continuous annealing, which has been proposed for example in Japanese Published Patent Application No. 3923/1973 to attain energy saving, can also be employed for the final annealing. In continuous annealing, the annealing separator is not necessary, and, thus electromagnetic steel strips without a glass film can be obtained and subjected to the laser-beam irradiation, so as to decrease the watt loss.

The electromagnetic steel strips or sheets without glass film, which have to be annealed either continuously or batchwise, may be subjected to bluing, thereby forming a thin oxide layer on the sheet surface, followed by the laser-beam irradiation. The absorption of the laser beam can be enhanced by the thin oxide layer. The bluing can be carried out at the withdrawal section of the flattening line in a case of batchwise annealing of coils and at the withdrawal section of the annealing line in the case of continuous annealing. The bluing treatment may be realized by exposing steel strips or sheets to a temperature of 600° C. and higher in an atmosphere of air, nitrogen or nitrogen plus hydrogen. Instead of the thin oxide layer formed by the bluing treatment, an agent other than such oxide, for penetration the laser beam, may be applied on the sheet surface. For example, a solution based on chromic acid may be applied and copper and the like may be thinly plated on the sheet surface.

A liquid agent for forming the insulating film, which is baked at a sheet temperature of 600° C. or less, may be mainly composed of at least one member selected from the group consisting of phosphate and chromate, and additionally composed of at least one member selected from the group consisting of colloidal silica, colloidal alumina, titanium oxide and a compound of boric acid. The liquid agent may further comprise one or more organic compounds: (1) a reducing agent of chromate, such as polyhydric alcohol, and glycerin; (2) water soluble- or emulsion-resins for enhancing workdability of steel sheets, and (3) organic resinous powder having a grain diameter of 1 micron or more for enhancing resistance and workability of steel sheets. A liquid agent for forming the insulating film may be a type that can be cured by ultraviolet rays.

In summary, the present invention, in which the electromagnetic steel strips or sheets have marks of the laser-beam irradiation on the steel sheet surface and an insulating film which is formed by baking at a temperature of not more than 600° C., preferably 550° C., more preferably 500° C., is advantageous over the prior art in the following points: a glass film can be omitted as a result of the conspicuous decrease in the watt loss due to the laser-beam irradiation; the thickness of insulating film can be thin and, thus, a low magnetostriction and a high space factor as well as firm bonding of the insulating film to the sheet surface can be attained; the production step can be shortened because of omission of the glass film and the thin insulating film; electromagnetic steels of high grade can be produced because of low watt loss and space factor as well as elimination of the glass film and formation of a thin insulating film instead, and; operation conditions of the production of electromagnetic steel strips is made less severe mainly due to the short annealing time of the final annealing. It would be obvious to persons skilled in the art of the electromagnetic steels that the treatment method of the present invention explained hereinabove with regard to the grain-oriented electromagnetic steels can also be applied for the non-oriented electromagnetic steels.

The present invention is explained hereinafter with regard to Examples.

EXAMPLE 1

0.30 mm thick grain-oriented electromagnetic steel sheets containing 2.9% Si, 0.003% C, 0.080% Mn and 0.031% Al were produced by the following procedures. A hot-rolled coil was cold reduced by a single cold rolling followed by annealing, then coated with magnesia, dried and coiled. The coil was finally annealed at 1150° C. for a secondary recrystallization, then excess magnesia was removed, and the steel strip having a glass film was flattened by heating the steel strip at 850° C. for 70 seconds. Samples were cut from the thus obtained grain-oriented electromagnetic steel strip and subjected to the following treatments.

Treatment A (conventional treatment): as flattened

Treatment B: samples were subjected to laser-beam irradiation under the following conditions.

Energy density (P): 1.5 J/cm$^2$

Diameter of marks of laser-beam irradiation: 0.1 mm

Distance (a) of centers of marks from each other in the cross rolling direction (c.f. FIG. 3A): 0.5 mm
Distance (l) of marks from each other in the rolling direction (c.f. FIG. 3A): 10 mm Treatment C: After the laser-beam irradiation under the same conditions as in Treatment B, an insulating film was formed under the following conditions.

(1) Liquid agent for treatment
20% colloidal silica—100 cc
50% aluminum phosphate—60 cc
$CrO_3$—6 g
boric acid—2 g
(2) Baking temperature
500° C., 600° C., 700° C. and 800° C.
(3) Coating amount
3.0 g/m$^2$ Treatment E (conventional treatment): The agent used in Treatment C was applied on the electromagnetic steel strip at an amount of 5.5 g/m$^2$ before flattening and baked simultaneously with the flattening.

Magnetic properties and properties of film of Samples are given in Table 1. The adhesion property given in Table 1 was measured by peeling test of the insulating film.

TABLE 1

| Treatments | Magnetic Properties: Watt Loss (W 17/50) (W/kg) | Magnetic Flux Density ($B_{10}$) (T) | Magneto striction ($\times 10^{-6}$) 17 kg | Properties of Film: Resistance ($\Omega$-cm$^2$/sheet) | Adhesion Property (mm$\phi$) | Space Factor (%) |
|---|---|---|---|---|---|---|
| Treatment A | 1.18 | 1.94 | +1.17 | 5 | 30 | 98.5 |
| Treatment B | 1.01 | 1.94 | −0.13 | 3 | 30 | 98.5 |
| Treatment C | | | | | | |
| 500° C. | 0.98 | 1.93 | −0.11 | 250 | 30 | 98.3 |
| 600° C. | 1.01 | 1.93 | −0.13 | 320 | 30 | 98.4 |
| 700° C. | 1.15 | 1.93 | −0.19 | 210 | 30 | 98.2 |
| 800° C. | 1.16 | 1.93 | −0.21 | 280 | 30 | 98.3 |
| Treatment E | 1.14 | 1.93 | −0.23 | 420 | 100 | 97.5 |

As is apparent from Table 1, the watt loss and magnetostriction properties of the samples treated by the laser-beam irradiation after flattening (Treatment B) and by the laser-beam irradiation and then the insulating-film formation at the sheet temperature of 600° C. or lower (Treatment C) are improved over those of conventional treatments. The watt loss of the sample of Treatment C, whose insulating film was baked at 500° C., is less than that of Treatment B. The coating amount of liquid agent for forming the insulating film is 3 g/m$^2$ and 5.5 g/m$^2$ in Treatment C and Treatment E, respectively. Therefore, excellent magnetic properties can be obtained by the treatment of the present invention, while using a smaller amount of the liquid agent for forming the insulating film than in the conventional Treatment E. In addition, the adhesion property and space factor of Treatment C are superior to those of Treatment E.

EXAMPLE 2

Grain oriented electromagnetic steel sheets containing 3.2% Si, 0.003% C, 0.065% Mn, 0.020% S and 0.031% Al were produced by the following procedure. A hot-rolled coil was cold reduced by repeating twice cold rolling followed by annealing, then coated with magnesia, dried and coiled. The coil was finally annealed at 1180° C. for a secondary recrystallization. The finally annealed coil was divided into two sections, and a half of the coil was subjected to the removal of excess magnesia and the thus obtained steel strip having a glass film was flattened by heating the steel strip at 870° C. for 80 seconds. The other half of the coil was subjected to the removal of the glass film by using a 25% HCl solution having a temperature of 80° C. and then flattened by heating the steel strip at 870° C. for 80 seconds. Since the steel strip was free from the glass film, the bluing of the sheet surface was complete. Samples were cut from both halves of the thus obtained grain-oriented electromagnetic steel strip and subjected to the following treatment.

Treatment F (conventional treatment): steel strip with a glass film was flattened.

Treatment G: samples were subjected to laser-beam irradiation under the following conditions.
Energy density (P): 1.3 J/cm$^2$
Diameter of marks of laser-beam irradiation: 0.15 mm
Distance (a) of centers of marks from each other in the cross rolling direction (c.f. FIG. 3A): 0.5 mm
Distance (l) of marks from each other in the rolling direction (FIG. 3A): 7.5 mm Treatment H: After Treatment F, an insulating film was formed under the following conditions.

(1) Liquid agent for treatment
$CrO_3$—10 g
MgO—3 g
glycerin—1 g
emulsion type acrylresin—4 g
(2) Baking temperature (sheet temperature)
300° C.
(3) Coating amount
2 g/m$^2$ Treatment I: After Treatment F, the laser-beam irradiation and then the formation of the insulating film were carried out.

(1) Conditions of laser-beam irradiation
The same as in Treatment G
(2) Conditions for forming the insulating film
The same as in Treatment H Treatment J: the steel strip without the glass film is as bluing-treated.

Treatment K: After Treatment J, the insulating film was formed under the same conditions as in Treatment H.

Treatment L: After Treatment J, the laser-beam irradiation and then the formation of the insulating film were carried out.

(1) Conditions of laser-beam irradiation
The same as in Treatment G.
(2) Conditions for forming the insulating film
The same as in Treatment H Treatment M: After Treatment J, the laser-beam irradiation was carried out under the same conditions as in Treatment G.

Treatment N: After Treatment F, the liquid agent of Treatment C in Example 1 was applied on the sheet surface at a coating amount of 5 g/m$^2$.

Magnetic properties and properties of film of Samples are given in Table 2.

TABLE 2

| Treatments | Magnetic Properties: Watt Loss (W 17/50) (W/kg) | Magnetic Properties: Magnetic Flux Density ($B_{10}$) (T) | Properties of Film: Resistance (Ω-cm$^2$/sheet) | Properties of Film: Adhesion Property (mmϕ) | Properties of Film: Space Factor (%) |
|---|---|---|---|---|---|
| Treatment F (Conventional Treatment) | 1.23 | 1.84 | 10 | 20 | 98.8 |
| Treatment G | 1.17 | 1.83 | 3 | 20 | 98.8 |
| Treatment H | 1.23 | 1.83 | 380 | 20 | 98.5 |
| Treatment I | 1.14 | 1.83 | 390 | 20 | 98.5 |
| Treatment J | 1.20 | 1.84 | 0.8 | 57 | 99.0 |
| Treatment K | 1.20 | 1.84 | 350 | 10 | 98.8 |
| Treatment L | 1.12 | 1.83 | 400 | 10 | 98.7 |
| Treatment M | 1.12 | 1.83 | 0.5 | 57 | 98.9 |
| Treatment N (Conventional Treatment) | 1.20 | 1.83 | 450 | 50 | 97.6 |

As is apparent from Table 2, the formation of the insulating film (sheet temperature 300° C. and coating amount 2 g/m$^2$) subsequent to the laser-beam irradiation decreases the watt loss with regard to samples with the glass film (Treatment I) and samples without the glass film and provided with the bluing layer (Treatment L) as compared with the watt loss of the sample treated by the laser-beam irradiation but without the formation of the insulating film (Treatment G). The watt loss of samples treated by the laser-beam irradiation in the above mentioned Treatments I and L is less than that of: (a) samples, in which insulating film is formed on the glass film (Treatment H); (b) the sample, in which the insulating film was formed on the bluing layer (Treatment K), and; (c) Treatment N which is a conventional Treatment. In addition, the thickness of the insulating film can be decreased by Treatments I and L as compared with Treatment N, and, therefore the adhesion property and space factor of Samples I and L are superior to that of Treatment N.

EXAMPLE 3

A 2.3 mm thick hot rolled strip containing 3.0% Si, 0.0015% acid-soluble Al and 0.002% S was cold rolled to a thickness of 1.04 mm, subjected to an intermediate annealing at 850° C. over a time period of 3 minutes and cold rolled to a final thickness of 0.30 mm. The obtained cold rolled strip was decarburized by annealing at 850° C. over a period of 3 minutes and then continuously annealed at 1000° C. over a period of 5 minutes. The continuously annealed steel strip was irradiated by a laser beam at the withdrawal section of the continuous annealing furnace and then a liquid agent for forming insulating film applied on the sheet surface at an amount of 3 g/m$^2$ was baked at the sheet temperature of 500° C. The electromagnetic steel strip thus produced exhibited a watt loss ($W_{17/50}$) of 1.40 W/Kg and a magnetic flux density ($B_{10}$) of 1.81 T as magnetic properties and an insulation resistance of 520 Ω-cm$^2$/sheet and an adhesion property of 20 mm Ω as the properties of the film. The laser-beam irradiation conditions were as follows.

Energy density (P): 1.5 J/cm$^2$

Diameter (d) of each spot of laser-beam irradiation: 0.1 mm

Distance (a) between spots in the cross rolling direction: 0.5 mm

Distance (l) between spots in the rolling direction: 10 mm

The conditions for forming the insulating film were the same as in Treatment C of Example 1.

For comparison purposes, the same procedure under the same conditions as in the above described was carried out except that the treatments after the laser-beam irradiation were interrupted. The thus obtained electromagnetic steel strip exhibited as the magnetic properties a watt loss ($W_{17/50}$) of 1.47 W/Kg and magnetic properties ($B_{10}$) of 1.81 T.

EXAMPLE 4

A slab consisting of 0.046% C, 2.96% Si, 0.083% Mn, 0.025% S, 0.028% Al and 0.007% N, the balance being iron and unavoidable impurities was successively subjected to the known steps of: hot rolling; hot coil annealing; cold rolling (sheet thickness of 0.35 mm); decarburizing annealing; coating with MgO; final annealing, and; thermal flattening, so as to produce a finally annealed steel strip. The glass film formed on the sheet surface was removed by pickling using fluoric acid and then the steel strip was mirror-finished by chemical etching. An ultraviolet ray-curing type liquid agent for forming insulating film was applied on the mirror finished steel strip and cured by ultraviolet-ray irradiation at ambient temperature. The conditions of the laser-beam irradiation were as follows.

Energy density (P): 1.5 J/cm$^2$

Diameter (d) of each spot of the laser-beam irradiation: 0.15 mm

Distance (a) between spots in the cross rolling direction: 0.5 mm

Distance (l) between spots in the rolling direction: 5 mm.

Table 3 indicates the magnetic properties of the electromagnetic steel strip processed by the above procedure and the conventional procedure without the laser-beam irradiation.

TABLE 3

| | Step: After Final Annealing (0.35 m/m) | Step: After Mirror Finish (0.30 m/m) | Step: After laser-beam Irradiation | Step: After Formation of Insulating Film | Step: Conventional Procedure |
|---|---|---|---|---|---|
| Magnetic Flux Density $B_{10}$ (T) | 1.95 | 1.96 | 1.96 | 1.96 | 1.96 |
| Watt Loss W 17/50 (W/Kg) | 1.21 | 0.97 | 0.92 | 0.92 | 0.98 |

We claim:

1. A method for treating an electromagnetic steel sheet to reduce its watt loss after completion of its final heat treatment, and comprising irradiating at least one surface of the finally heat-treated sheet with a laser beam having an energy density of from 0.01 to 1000 J/cm$^2$ so as to mark the sheet's surface and cause a substantial reduction in the sheet's watt loss, and thereafter a liquid insulating film-forming agent requiring treating at temperatures not higher than 600° C. is coated on the surface and the coated sheet is treated at temperatures not higher than 600° C. so as to form an insulating film on the surface.

2. The method of claim 1 in which the treating temperature is not higher than 550° C.

3. The method of claim 1 in which the treating temperature is not higher than 500° C.

4. The method of claim 1 in which the agent is substantially free from colloidal silica.

5. The method of claim 1 in which the agent is coated on the sheet's surface in an amount of from 2 to 3 g/m$^2$.

6. The method of claim 1 in which at the time of the irradiating the sheet's surface is free from a glass film.

7. The method of claim 1 in which at the time of the irradiating the sheet's surface is coated with a thin film of a substance selected from the class consisting of steel blueing, chromic acid solution and copper and through which the laser beam can penetrate.

8. The method of claim 7 in which the thin film is steel blueing and is formed by exposing the sheet at temperatures of at least 600° C. to oxidizing conditions, and enhances the sheet's absorption of the laser beam irradiation.

* * * * *